US009479855B2

(12) United States Patent
Huang et al.

(10) Patent No.: US 9,479,855 B2
(45) **Date of Patent: *Oct. 25, 2016**

(54) HEADPHONE EAR CUP

(71) Applicant: MERRY ELECTRONICS (SHENZHEN) CO., LTD., Shenzhen (CN)

(72) Inventors: Chung-Yi Huang, Taichung (TW); Chih-Feng Chao, Taichung (TW); Yu-Jen Cho, Taichung (TW)

(73) Assignee: MERRY ELECTRONICS (SHENZHEN) CO., LTD. (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/548,446

(22) Filed: Nov. 20, 2014

(65) Prior Publication Data

US 2016/0150306 A1 May 26, 2016

(51) Int. Cl.

| | |
|---|---|
| ***H04R 25/00*** | (2006.01) |
| ***H04R 1/10*** | (2006.01) |
| ***H04R 5/033*** | (2006.01) |

(52) U.S. Cl.

CPC ..... *H04R 1/1008* (2013.01); *H04R 1/10* (2013.01); *H04R 1/1058* (2013.01); *H04R 5/033* (2013.01); *H04R 1/1083* (2013.01); *H04R 2201/105* (2013.01); *H04R 2460/15* (2013.01)

(58) Field of Classification Search

CPC H04R 1/1008; H04R 1/1058; H04R 1/1083; H04R 5/033; H04R 5/0335; H04R 2201/105; H04R 2201/107; H04R 2460/15; H04R 1/10; A61F 11/14

USPC ..... 381/309, 71.6, 370, 371, 372, 374, 376; 181/128, 129; 2/209, 909

See application file for complete search history.

(56) References Cited

U.S. PATENT DOCUMENTS

| | | | | |
|---|---|---|---|---|
| 4,856,118 | A * | 8/1989 | Sapiejewski | H04R 1/1008 181/129 |
| 8,638,969 | B2 * | 1/2014 | Kuhtz | H04R 1/1008 381/371 |
| 2005/0273910 | A1 * | 12/2005 | Cozens | A42B 3/12 2/411 |
| 2009/0110226 | A1 * | 4/2009 | Ishida | H04R 1/1008 381/370 |

* cited by examiner

*Primary Examiner* — Huyen D Le

(74) *Attorney, Agent, or Firm* — Bacon & Thomas, PLLC

(57) ABSTRACT

A headphone ear cup includes a composite cushion and a cover wrapping around the composite cushion. The composite cushion has an annular body and an air-permeable portion arranged at the outer periphery of the annular body. The air-permeable portion is made of a porous material having a porosity higher than that of the annular body. Because the annular body made of the material having relatively high density can maintain the sound output performance of the earphones, and the air-permeable portion made of the porous material having relatively low density can provide better heat dissipation effect, the headphone ear cup has excellent air-permeable property and improved acoustic field effect.

3 Claims, 2 Drawing Sheets

HEADPHONE EAR CUP

BACKGROUND OF THE INVENTION

1. Field of the Invention

The present disclosure relates to a headphone ear cup and more particularly, to a headphone ear cup having a composite cushion which has an inner side portion and an outer side portion respectively made of foam materials having different densities, such that the headphone ear cup can have excellent air-permeable property and improved acoustic field effect.

2. Description of the Related Art

A traditional headphone ear cup is substantially annular in shape and connected with a surface of a speaker of a headphone, and usually comprises an annular cushion and a cover covering the annular cushion.

In order to isolate the ambient sound as far as possible to enable a user to clearly hear the sound from the speaker of the headphone through the sound guiding hole of the headphone ear cup, the cushion disposed inside the traditional headphone ear cup is usually made of a single foam material with high density, thereby sacrificing the air-permeable property of the cushion. As such, the user may feel uncomfortable after using the traditional headphone ear cup having the cushion with low air-permeable property.

SUMMARY OF THE INVENTION

In light of the above, the primary objective of the present disclosure is to provide a headphone ear cup having excellent air-permeable property and improved acoustic field effect.

To attain the above objective, the present disclosure provides a headphone ear cup for disposing on a surface of a speaker of a headphone, which comprises a composite cushion provided inside the headphone ear cup. The composite cushion has an annular body and at least one air-permeable portion arranged at an outer periphery of the annular body. The annular body has a sound guiding hole at the center thereof. The at least one air-permeable portion is made of a porous material having a porosity higher than that of the annular body.

Because the air-permeable portion made of the material having high porosity can provide better heat dissipation effect, and the annular body made of the material having high density can prevent the sound from penetrating through the annular body, the ear cup of the present disclosure can have excellent air-permeable property thus providing comfortable feeling to a user and can improve the acoustic filed effect so as to have good sound quality.

DETAILED DESCRIPTION OF EMBODIMENTS

Figure 1:
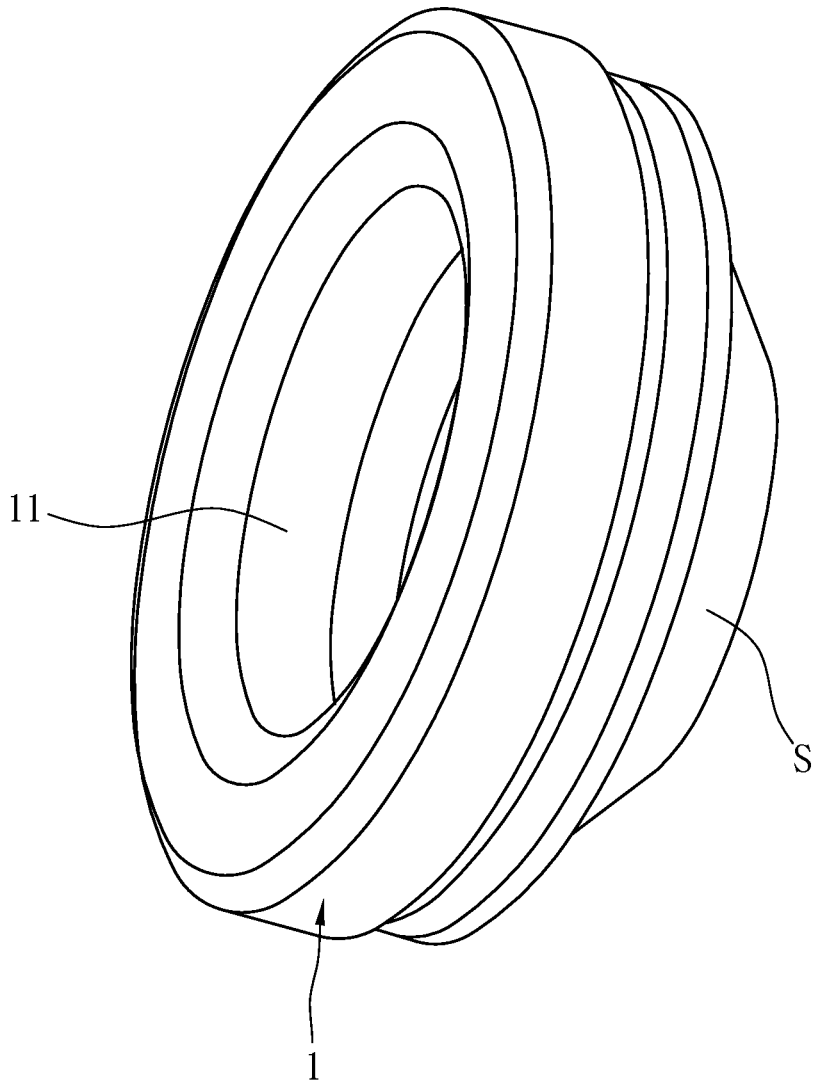
FIG. 1 is a perspective view of a headphone mounted with a headphone ear cup according to a first embodiment of the present disclosure.
Figure 2:
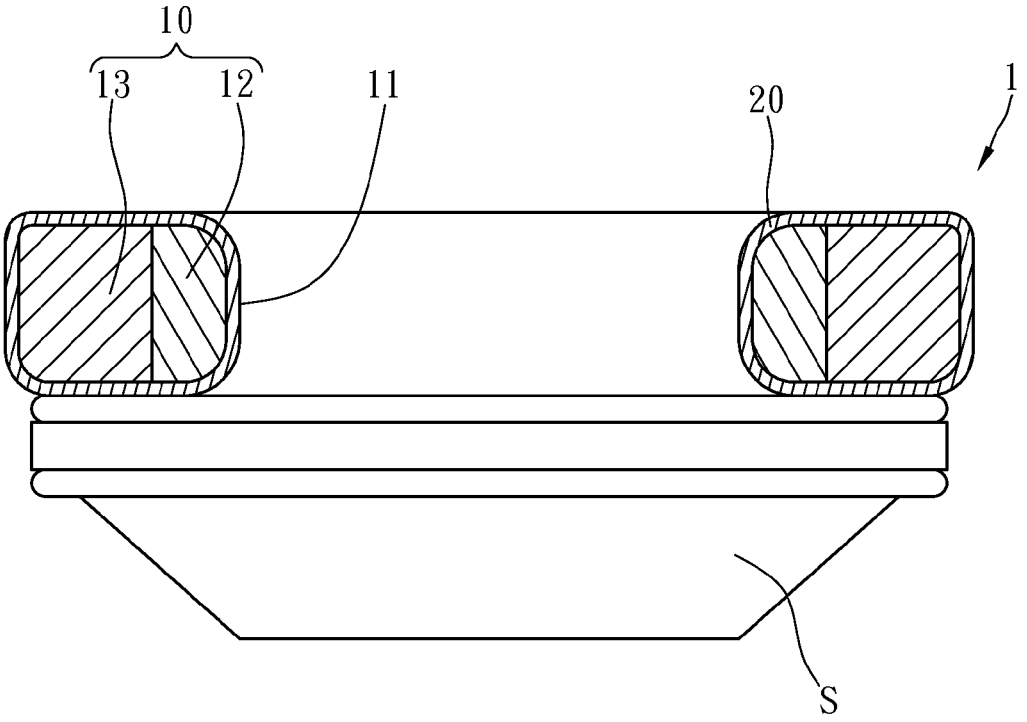
FIG. 2 is a partial cross-sectional view of FIG. 1, showing the structure of the headphone ear cup of the first embodiment.

For better understanding of the feature of the present disclosure, the present disclosure provides a first embodiment described by reference to the accompanying drawings. Referring to FIG. 2, an ear cup for a headphone is taken as an example in the following illustration. The ear cup 1 of the present disclosure mainly includes a composite cushion 10 and a cover 20. The structures of these components and relationship therebetween are described in detail as follows.

The composite cushion 10 is substantially shaped as a circular ring and disposed on a surface of a speaker S of a headphone. The composite cushion 10 has an annular body 12 and an air-permeable portion 13. The annular body 12 has a sound guiding hole 11 at the center thereof for passing of the sound outputted from the speaker S. The annular body 12 is made of a foam material having relatively high density and relatively small pore size flow porosity). The air-permeable portion 13 also has an annular shape and surrounds around the outer periphery of the annular body 12. In addition, the air-permeable portion 13 is made of a foam material having relatively high porosity and relatively large pore size so as to provide a better air permeability.

The cover 20 wraps around a surface of the composite cushion 10 and is made of cool-feeling fabrics having high air permeability.

Because the annular body 12 is made of the foam material having relatively high density, the sound outputted from the speaker S will penetrate the annular body 12 with difficulty, such that the annular body 12 can provide a better sound insulation effect for enabling most of the sound from the speaker S to directly enter into a user's ear through the sound guiding hole 11. Moreover, because the air-permeable portion 13 is made of the foam material having relatively high porosity, the cover 20 and the air-permeable portion 13 can form a heat dissipation path so as to provide comfortable feeling to the user wearing the headphone provided with the ear cup of the present disclosure. Accordingly, the headphone ear cup of the present disclosure possesses superior heat dissipation and excellent sound quality due to improved acoustic field effect in comparison with the conventional headphone ear cup.

It has to be noted that the air-permeable portion 13 of the present disclosure is not limited to the above-mentioned embodiment, and those skilled in the relevant art may change the shape and the location of the air-permeable portion 13 so long as the air-permeable portion 13 and the cover 20 can form a better heat dissipation path. For example, the composite cushion 10 may comprise a plurality of air-permeable portions 13 that are spaced at equal angle intervals and located at or arranged along with the outer periphery of the annular body 12.

Figure 3:
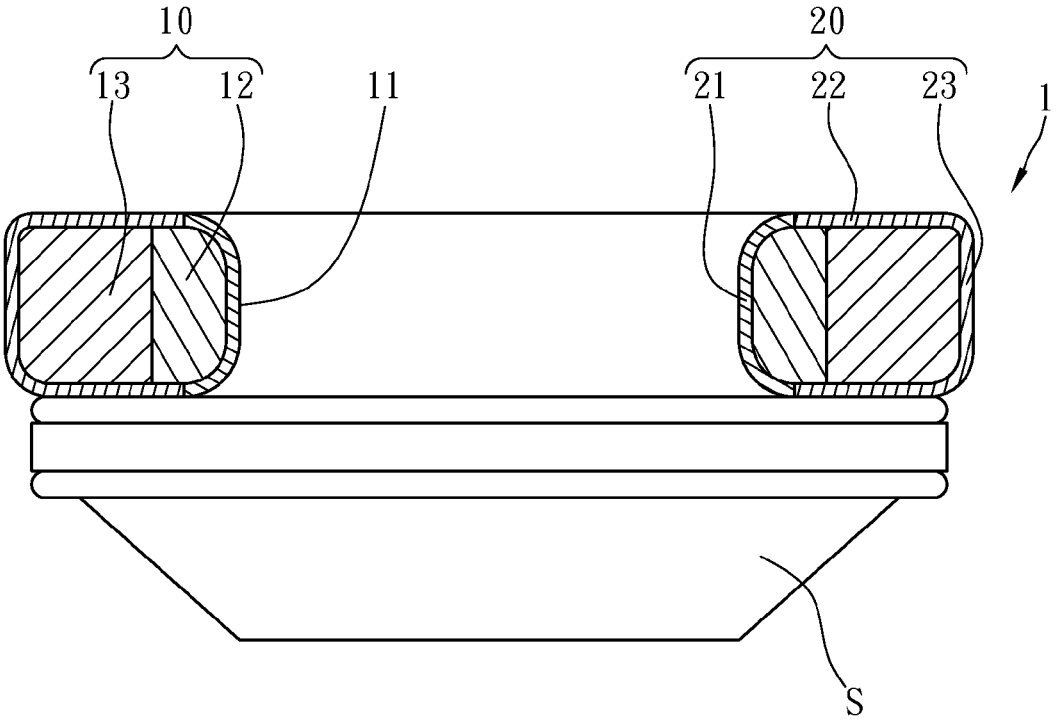
FIG. 3 is a partial cross-sectional view, showing the structure of a headphone ear cup according to a second embodiment of the present disclosure.

In order to further enhance the heat dissipation effect of the present disclosure, a second embodiment is provided in FIG. 3. The ear cup of the second embodiment is substantially the same as that of the first embodiment, except that the cover 20 is formed by sewing two different fabrics. The cover 20 can be divided into at least an inner-side portion 21, an ear-abutting portion 22 and an outer-side portion 23. The inner-side portion 21 surrounds around the whole of the sound guiding hole 11, and the outer-side portion 23 is opposite to the inner-side portion 21 spacedly and remote away from the sound guiding hole 11. The outer-side portion 23 is abutted with the outer periphery of the air-permeable portion 13, and the ear-abutting portion 22 is connected between the outer-side portion 23 and the inner-side portion 21 and is disposed in a way that the back of the ear-abutting portion 22 is spaced away from the speaker S. The ear-abutting portion 22 and the outer-side portion 23 are made of a cool-feeling fabrics having relatively high air permeability, whereas the inner-side portion 21 is made of fabrics having relatively low air permeability. As such, the ear-abutting portion 22 is used to contact with the user's skin to provide a better air permeability, and the air-permeable portion 13 and the outer-side portion 23 are used to form the heat dissipation path to improve the heat dissipation effect of the headphone ear cup 1.

The above-mentioned descriptions represent merely the exemplary embodiment of the present disclosure, without any intention to limit the scope of the present disclosure thereto. Various equivalent changes, alternations or modifications based on the spirit and scope of the present disclosure are intended to be included within the scope of the following claims.

What is claimed is:

1. A headphone ear cup, characterized in that the headphone ear cup is provided at an inside thereof with a composite cushion including an annular body and at least one air-permeable portion having different porosities respectively, the annular body is provided at a center thereof with a sound guiding hole and has an outer periphery positioned radially apart from the sound guiding hole, and the at least one air-permeable portion is disposed at the outer periphery of the annular body and made of a porous material having a porosity higher than that of the annular body; and further comprising a cover wrapping around the composite cushion wherein the cover has an ear-abutting portion, an inner-side portion surrounding the sound guiding hole, and an outer-side portion opposite to the inner-side portion spacedly and remote from the sound guiding hole; each of the ear-abutting portion and the outer-side portion has an air permeability higher than that of the inner-side portion.

2. The headphone ear cup as defined in claim 1, wherein the composite cushion comprises one said air-permeable portion surrounding around the outer periphery of the annular body.

3. The headphone ear cup as defined in claim 1, wherein the composite cushion comprises a plurality of said air-permeable portions arranged along the outer periphery of the annular body.

* * * * *